US007958832B2

(12) United States Patent
Meeker

(10) Patent No.: US 7,958,832 B2
(45) Date of Patent: Jun. 14, 2011

(54) AWL FOR MAKING AN AWL FEATURE IN MATERIAL FOR APPAREL

(75) Inventor: Jason R. Meeker, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 418 days.

(21) Appl. No.: 12/201,666

(22) Filed: Aug. 29, 2008

(65) Prior Publication Data

US 2010/0050913 A1 Mar. 4, 2010

(51) Int. Cl.
*D05B 15/00* (2006.01)
*D05B 85/00* (2006.01)

(52) U.S. Cl. ..... 112/48; 112/222; 223/104

(58) Field of Classification Search ..... 112/47–49, 112/439, 128, 129, 475.08, 475.17, 475.18; 223/102, 104; 83/30, 660, 669, 905, 910, 83/936

See application file for complete search history.

(56) References Cited

U.S. PATENT DOCUMENTS

| | | | | |
|---|---|---|---|---|
| 227,192 | A * | 5/1880 | Wagner et al. | 112/222 |
| 971,663 | A * | 10/1910 | Carlson | 223/104 |
| 1,689,633 | A * | 10/1928 | Lupien | 69/2 |
| 1,998,418 | A * | 4/1935 | Fridolph | 223/102 |
| 4,036,047 | A * | 7/1977 | Miller | 72/347 |
| 4,290,375 | A | 9/1981 | Tonomura et al. | |
| 5,664,464 | A | 9/1997 | Carson | |
| 5,778,806 | A * | 7/1998 | Badillo | 112/68 |
| 6,216,618 | B1 | 4/2001 | Goldberg et al. | |
| 6,321,669 | B1 | 11/2001 | Park | |
| 2006/0112867 | A1 | 6/2006 | Weinberg et al. | |
| 2007/0044696 | A1 * | 3/2007 | Yang | 112/222 |

FOREIGN PATENT DOCUMENTS

| | | | |
|---|---|---|---|
| JP | 41143858 | A * | 2/1999 |
| JP | 2006-075250 | | 3/2006 |

OTHER PUBLICATIONS

International Search Report dated Oct. 30, 2009, from International Application No. PCT/US2009/55054, International Filing Date Aug. 26, 2009.

Written Opinion of the International Searching Authority dated Oct. 30, 2009, from International Application No. PCT/US2009/55054, International Filing Date Aug. 26, 2009.

* cited by examiner

*Primary Examiner* — Ismael Izaguirre

(74) *Attorney, Agent, or Firm* — Harness, Dickey & Pierce, P.L.C.

(57) ABSTRACT

An awl for use with a reciprocating device. The awl includes a mounting portion for operably engaging the reciprocating device. The awl also includes a shaft portion with an end for forming an awl feature on a sheet of material. Furthermore, the awl includes a mass portion for increasing the inertia of the awl when reciprocated by the reciprocating device toward the sheet of material.

23 Claims, 4 Drawing Sheets

AWL FOR MAKING AN AWL FEATURE IN MATERIAL FOR APPAREL

FIELD

The present disclosure relates to apparel and, more particularly, relates to an awl for making an awl feature in material for apparel.

BACKGROUND

This section provides background information related to the present disclosure which is not necessarily prior art.

Articles of apparel, such as clothing, footwear and the like, can include a wide variety of perforations, depressions, and other similar features. For instance, footwear can include an upper with a perforation pattern (i.e., a plurality of small apertures) that increases ventilation for cooling the wearer's feet. Footwear can also include various depressions arranged in a pattern that identifies the particular style or model. These features can also make the apparel more aesthetically pleasing.

Typically, perforation patterns are formed using a perforation plate tool, which includes a cutting die and a plurality of small rod-like punches. During use, the perforation plate tool actuates toward a sheet of bulk material, the cutting die cuts a piece of material from bulk, and the punches simultaneously perforate the piece to create the perforation pattern thereon. The piece of material can subsequently be used to form the desired article of apparel.

Other related methods include use of a wheel having awl-type tools that extend out from a rotatable wheel. The wheel rolls over at least a portion of the bulk material, and the awl-type tools create depressions, perforations, etc. in the bulk material. Then, a piece of material is cut from the bulk material and the desired article of clothing is formed therefrom.

Although these methods have been adequate for creating perforations, depressions, and other "awl features," problems remain. For instance, these methods may not be adequate for forming more intricate awl features, such as patterns that form intricate shapes, logos, etc. An intricate perforation pattern can include perforations that are spaced relatively close together, and the size of the tools in the perforation plate tool or wheel can be too large to create these closely spaced patterns. Additionally, the awl-type tools can be so large that the resultant perforation is misshaped. Also, if the size of the tools is reduced, they may bend, fracture, or otherwise fail to penetrate or mark the material adequately.

Moreover, while these conventional manufacturing methods are suited for mass manufacture of apparel, these methods may not be adequate for customizing the apparel or for manufacturing apparel in smaller quantities. For instance, if a user wishes to apply a custom perforation pattern to a relatively small number of articles, a custom perforation plate or wheel would likely need to be made, which can be prohibitively expensive.

Furthermore, as stated, the perforations, depressions, or other awl features are formed in the material before or simultaneously while being cut from bulk. As such, it can be difficult to properly align the awl features on the completed article of apparel. For example, a perforation pattern representing a flower can be formed on a bulk sheet of material. It can be difficult to cut a panel sheet from this bulk sheet and then properly align the flower pattern on the resultant article of apparel. This problem is exacerbated if the article of apparel is to be produced in multiple sizes, since the panel sheet having the perforation pattern will likely be cut differently and assembled differently for each size.

As an alternative, a laser cutter can be used to create highly detailed or custom perforation patterns. The laser cutter can transmit a laser through the material to form the perforation pattern thereon. However, this method can be prohibitively expensive and relatively complex. Also, laser cutting processes may not be suitable for creating depressions in the material. Moreover, the laser can damage some materials.

SUMMARY

Accordingly, despite the improvements of the known devices described above, there remains a need for an economical awl that quickly and easily applies awl features to sheets of material. In addition to other benefits that will become apparent in the following disclosure, the device of the present disclosure fulfills these needs.

An awl for use with a reciprocating device has a mounting portion for operably engaging the reciprocating device and a shaft portion with an end for forming an awl feature on a sheet of material. The awl has a mass portion for increasing the inertia of the awl when reciprocated by the reciprocating device toward the sheet of material.

In another aspect, a method of making an awl feature in a sheet of material is disclosed. The method includes cutting the sheet of material from a bulk amount of material and mounting the sheet of material relative to the reciprocating device after the sheet of material has been cut from the bulk amount of material. Furthermore, the method includes operably engaging a mounting portion of an awl to the reciprocating device. Moreover, the method includes reciprocating the awl toward the sheet of material using the reciprocating device to form the awl feature on the sheet of material.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
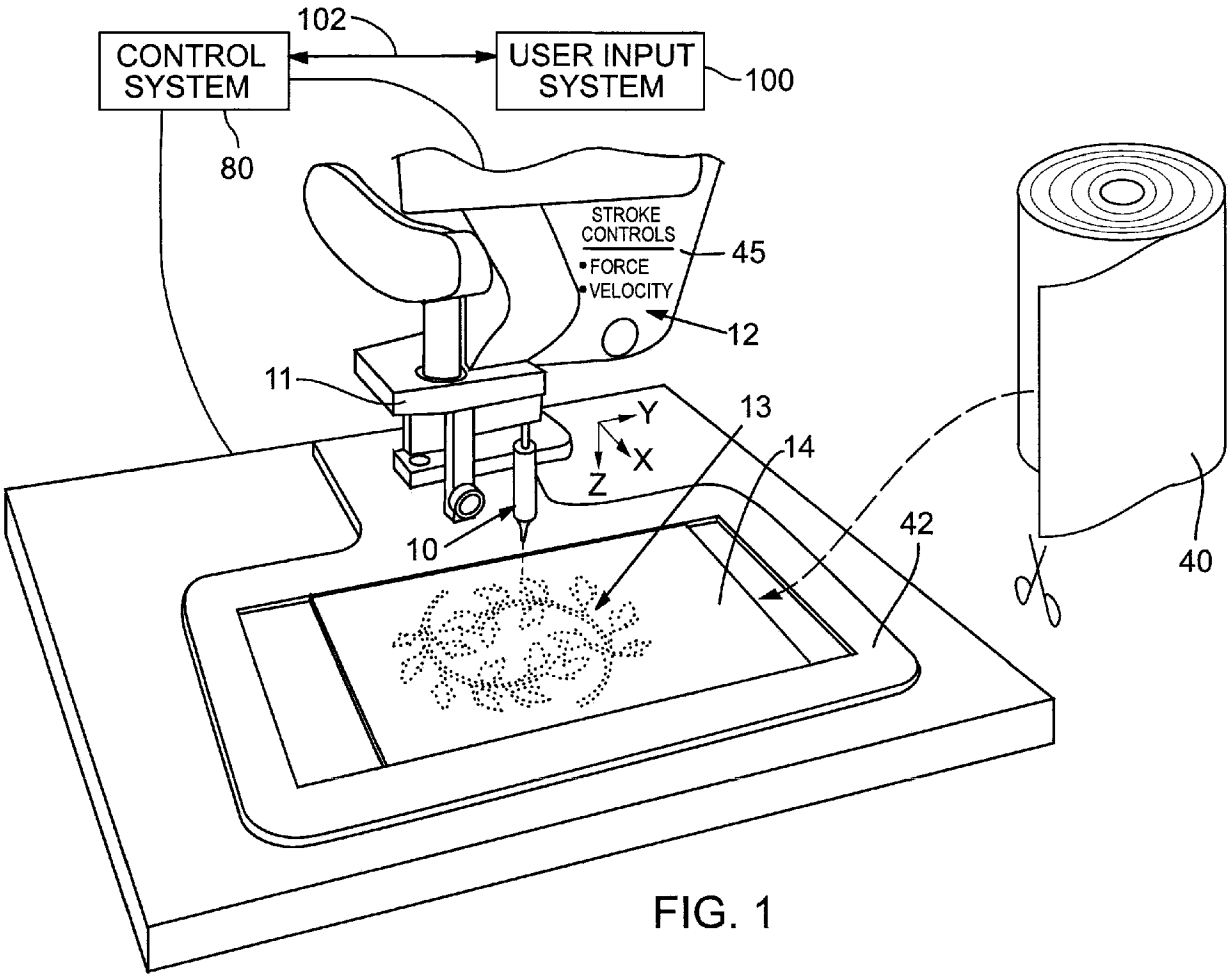
FIG. 1 is a perspective view of an awl according to various teachings of the present disclosure, wherein the awl is shown in a possible orientation on a reciprocating machine, which is shown in partial view.
Figure 2:
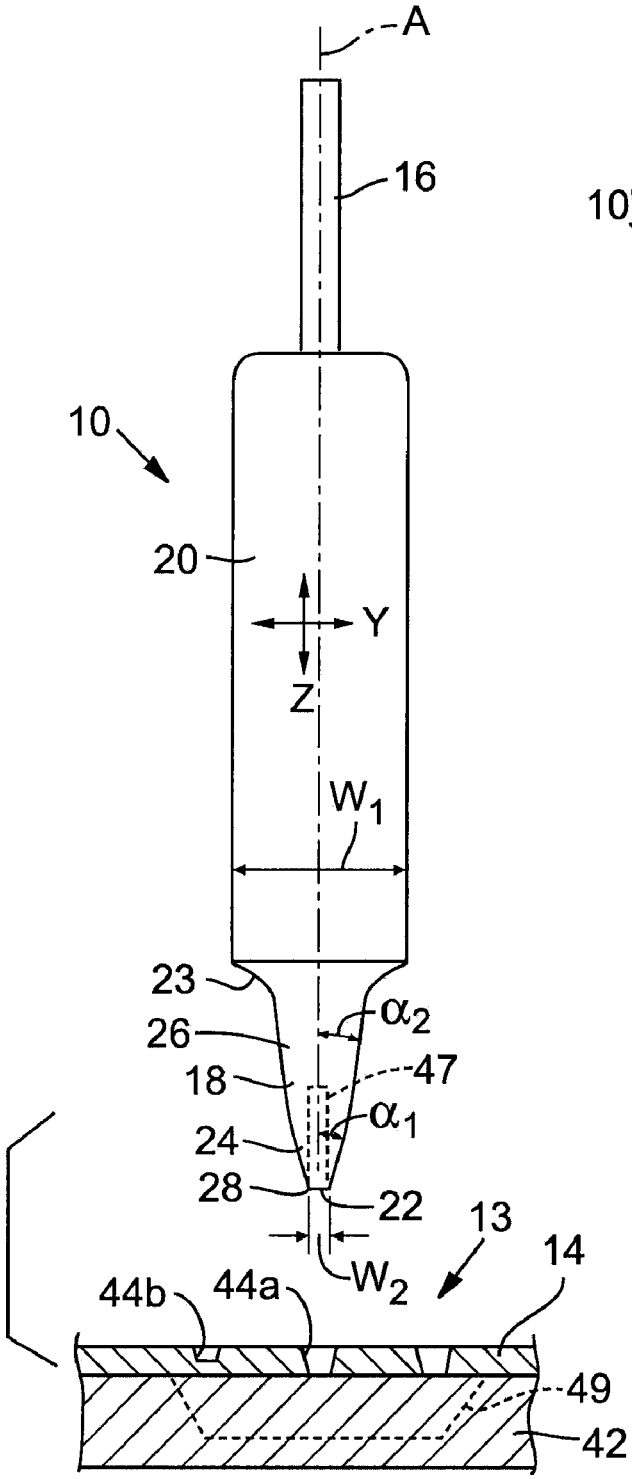
FIG. 2 is a side view of the awl of FIG. 1 showing a possible orientation relative to a piece of material on which the awl makes awl features.

Referring initially to FIGS. 1 and 2, an awl is generally indicated at 10. The awl 10 is operably secured to a reciprocating arm 11 of a reciprocating device 12 for creating an "awl feature" 13 in a sheet of material 14. More specifically, as will be described in greater detail, the awl 10 is a pointed tool used for marking, piercing, punching, and other similar operations. Also, as will be described, the reciprocating device 12 is operable for moving the awl 10 relative to the sheet of material 14, and when the awl 10 moves generally toward the sheet of material 14, the awl 10 can create perforations, depressions, and other similar awl features 13 in the sheet of material 14.

The reciprocating machine 12 can be of any suitable type, such as a commercially available embroidery machine, which is ordinarily used to add decorative embroidery to a piece of material, or a commercially available stitching machine, which is ordinarily used to stitch multiple pieces of material together. As will be described, the awl 10 can be specifically designed and can be particularly useful for converting such an embroidery machine or stitching machine for use in creating the awl features 13 in the sheet of material 14. Accordingly, the awl 10 and reciprocating machine 12 can be used for creating highly detailed and intricate patterns of awl features 13. In the embodiment illustrated, for instance, the awl features 13 are arranged in a pattern representing foliage. However, it will be appreciated that the awl features 13 can be arranged in any desired pattern without departing from the scope of the present disclosure.

Referring to FIG. 2, the awl 10 is shown in greater detail according to various embodiments of the present disclosure. In some embodiments, the awl 10 is generally elongate and defines a straight axis A. The awl 10 can be formed on a lathe (not shown) from bar stock.

The awl 10 generally includes a mount portion 16, a shaft portion 18, and a mass portion 20. In some embodiments, the mount portion 16 and shaft portion 18 are disposed on opposite ends of the awl 10, and the mass portion 20 is disposed therebetween. The mount portion 16, shaft portion 18, and mass portion 20 are axially aligned along the axis A. In some embodiments, the mount portion 16, shaft portion 18, and mass portion 20 are integrally attached so as to be monolithic.

The mount portion 16 is substantially cylindrical and operably engages the reciprocating device 12. The mount portion 16 is preferably detachably secured to the reciprocating device 12 in a known manner, such as via a clamp (not shown), pin (not shown), etc.

As best shown in FIG. 2, the shaft portion 18 has an inverted, frusto-conic shape. The shaft portion 18 also defines an end 22 for forming the awl feature 13 as will be discussed. In some embodiments, the shaft portion 18 includes a rounded shoulder 23 adjacent the mass portion 20, a first tapered portion 24 adjacent the end 22, and a second tapered portion 26 adjacent the shoulder 23. The first tapered portion 24 is tapered at a first angle $\alpha_1$ relative to the axis A, and the second tapered portion 26 is tapered at a second angle $\alpha_2$ relative to the axis A. The second angle $\alpha_2$ is less than the first angle $\alpha_1$. Accordingly, the second tapered portion 26 tapers downward from the mass portion 20, and the first tapered portion 24 tapers further downward to the end 22. The dimensions of the tapered portions 24, 26 allow forces to transfer effectively through the awl 10 for making the awl features 13 effectively and such that fracture of the awl 10 is less likely.

The end 22 is substantially planar and defines an edge 28. In some embodiments, the edge 28 is substantially circular. In other embodiments, the edge 28 is ovate, star shaped, or has another suitable shape. The end 22, and thus the edge 28, is disposed substantially perpendicular to the axis A.

In some embodiments, the mass portion 20 is solid and substantially cylindrical. As shown, the width $W_1$ of the mass portion 20 is greater than the other portions of the awl 10 and is substantially greater than the width $W_2$ of the end 22 of the shaft portion 18. For instance, in some embodiments, the width $W_1$ is approximately four millimeters and the width $W_2$ is approximately 0.6 millimeters to 0.8 millimeters. Also, the mass portion 20 provides a significant amount of mass to the awl 10. Accordingly, the mass portion 20 provides an increased amount of inertia to the awl 10 for generating the necessary forces for creating the awl features 13 when the reciprocating arm 11 reciprocates the awl 10 toward and away from the sheet of material 14. Also, the mass portion 20 increases the rigidity of the awl 10 such that the awl 10 is more robust. Thus, the awl 10 can more readily impact and/or pierce the piece of material 14 and is less likely to bend, fracture, or otherwise fail during use.

Figure 3:
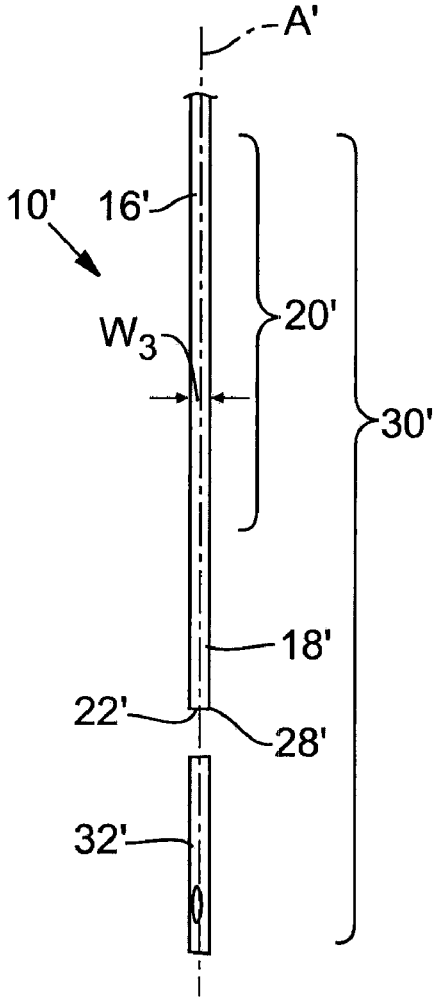
FIG. 3 is a side view of another embodiment of an awl according to various embodiments of the present disclosure.

Referring now to FIG. 3, the awl 10' is illustrated according to various other embodiments of the present disclosure. The awl 10' includes a mount portion 16', a shaft portion 18', and a mass portion 20', somewhat similar to the embodiment of FIG. 2. However, the width $W_3$ of the mass portion 20' is substantially equal to that of the mount and shaft portions 16', 18'. In other embodiments, the awl 10' tapers in a substantially continuous manner downward from the mount portion 16' along the length of the mass portion 20' and shaft portion 18'.

Also, the end 22' is disposed substantially perpendicular to the longitudinal axis A'. In other embodiments, the end 22' is disposed at a positive, acute angle relative to the longitudinal axis A' of the awl 10'.

In some embodiments, the awl 10' is formed from a commercially available embroidery needle 30'. More specifically, the embroidery needle 30' includes an eyelet portion 32' intended for attachment of embroidering thread. In order to make the awl 10', the eyelet portion 32' is removed. Accordingly, the outer surfaces of the awl 10' are substantially solid and continuous to ensure that the awl 10' is less likely to catch on the material during use. Accordingly, the awl 10' can be formed fairly easily. It will be appreciated that the awl 10' of FIG. 3 may be well suited for patterns in which the awl features 13 are relatively closely spaced and highly intricate because the end 22' can be made relatively small.

It will be appreciated that the awl 10' of FIG. 3 may have less strength and rigidity than the awl 10 of FIG. 2. To account for this potentiality, the end 22' defines a relatively sharp edge 28' that can more readily pierce the piece of material 13. Also, the awl 10' of FIG. 3 may have less mass (and, therefore, less inertia) than the awl 10 of FIG. 2. To account for this potentiality, the controls of the reciprocating machine 12 can be adjusted in such a manner that the awl 10' is sufficiently able to create the awl features 13. For instance, the stroke force and/or stroke velocity of the reciprocating machine 12 can be adjusted as will be described in greater detail below.

The method of forming the awl features 13 in the sheet of material 14 will now be discussed. Initially, the sheet of material 14 is cut from a bulk amount of material 40. In some embodiments, the sheet of material 14 is cut so as to be substantially planar. It will be appreciated that the material 14 can be of any suitable type, such as leather, nylon, cotton, poly-blended fabric, and the like.

Subsequently, the sheet of material 14 is operably secured to a work table 42 relative to the reciprocating machine 12. In some embodiments, the sheet of material 14 is mounted atop the work table 42 via a vacuum suction device (not specifically shown). Also, in some embodiments, multiple sheets of material 14 are stacked and operably secured to the work table 42 such that the awl features 13 can be simultaneously added to the multiple sheets of material 14. For instance, multiple sheets of material 14 can be loaded on the work table 42 of a commercially available embroidery machine, and the awl 10' can be used to form the awl features 13 simultaneously in the multiple sheets of material 14.

Then, the appropriate awl 10, 10' is mounted to the reciprocating device 12. In some embodiments, the awl 10 is used where the reciprocating device 12 is a stitching machine, and the awl 10' is used where the reciprocating device 12 is an embroidery machine. As shown in the embodiments represented in FIG. 1, the awl 10, 10' is supported generally above the sheet 14 such that the axis A of the awl 10, 10' is substantially perpendicular to the sheet 14 and such that the end 22, 22' extends generally toward the sheet 14.

Next, the reciprocating device 12 operates to move the awl 10, 10' relative to the sheet 14. Specifically, the device 12 reciprocates the awl 10, 10' generally toward and away from the sheet 14 along a Z axis (FIG. 1). While moving toward the sheet 14, the end 22 (FIG. 2), 22' (FIG. 3) abuts, depresses, pierces, and/or perforates the material of the sheet 14.

For example, as shown in FIG. 2, the end 22 can create a perforation 44*a* and a depression 44*b* in the sheet 14. In order to create the perforation 44*a*, the end 22 pierces the sheet 14. In some embodiments, the perforation 44*a* extends through the entire thickness of the sheet 14; however, in other embodiments, the perforation 44*a* extends only partially through the thickness of the sheet 14. Also, in some embodiments, the end 22 removes a portion of the material of the sheet 14, leaving the perforation 44*a*; however, in other embodiments, the end 22 merely pierces the sheet 14 without removing material therefrom. Furthermore, the end 22 creates the depression 44*b* by abutting and compressing the sheet 14, without piercing the sheet 14.

In some embodiments, the awl 10 includes a cavity 47 (shown in phantom in FIG. 2), which extends from the end 22 along the shaft portion 18. Material removed from the sheet of material 14 while making the perforation 44*a* is received within the cavity 47. Also, in some embodiments, the work table 42 includes a cavity 49 on a side of the sheet of material 14 opposite from the awl 10, and material removed from the sheet of material 14 while making the perforation 44*a* is received within the cavity 49. It will be appreciated that the cavity 47 could be included as an alternative to the cavity 49, and vice versa, or both cavities 47, 49 could be included without departing from the scope of the present disclosure.

As shown, in FIG. 1, the reciprocating device 12 can also move the awl 10, 10' within an X-Y plane (FIG. 1). Accordingly, the awl features 13 can be included in any suitable location on the surface of the sheet 14 to create a wide variety of patterns for decorative purposes, identification purposes, and the like.

It will be appreciated that the reciprocating device 12 could be in operable communication with a computerized, numerical control system 80 for automatically controlling the movement of the awl 10, 10'. Also, it will be appreciated that the reciprocating device 12 and control system 80 could be operably connected to the worktable 42 such that the worktable 42 is moved during the creation of the awl features 13 while the awl 10, 10' remains substantially stationary. Furthermore, it will be appreciated that the awl 10, 10' and the worktable 42 could both be moved during creation of the awl features 13 without departing from the scope of the present disclosure.

In addition, the reciprocating device 12 can include adjustable controls 45. In some embodiments, the reciprocating device 12 includes controls 45 for adjusting the stroke force (i.e., the amount of force of the awl 10, 10' directed along the Z axis), for adjusting the stroke velocity (i.e., the amount of velocity of the awl 10, 10' directed along the Z axis), or for controlling any other suitable parameter of the reciprocating device 12. These controls 45 can be adjusted depending on the type of awl 10, 10' used. For instance, if the awl 10 of FIG. 2 is used, the stroke force and/or velocity can be increased because the awl 10 is stronger and more rigid and can withstand such forces and/or velocities. However, if the awl 10' of FIG. 3 is used, the stroke force and/or velocity can be decreased to decrease the likelihood of failure of the awl 10'.

Figure 4:
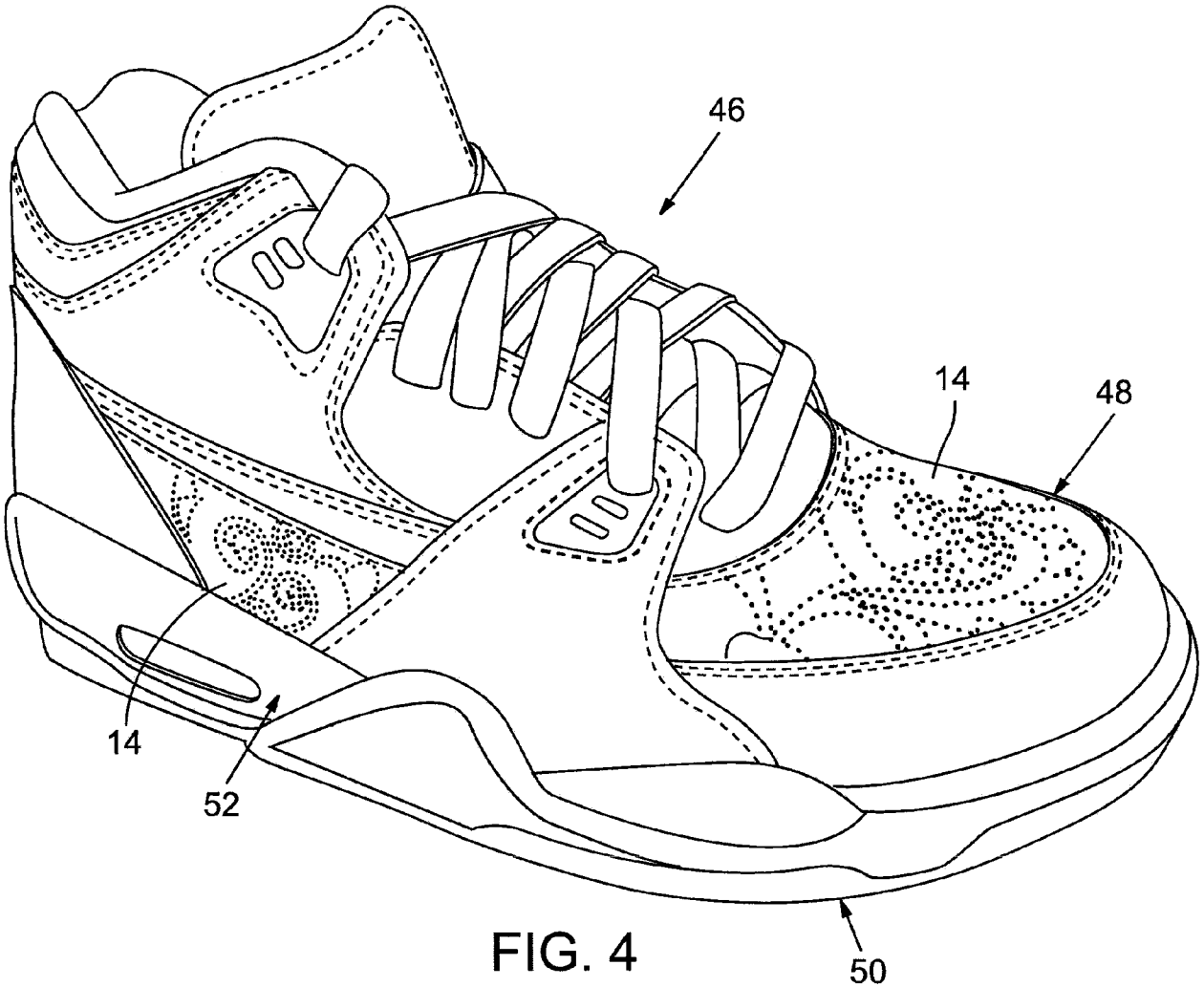
FIG. 4 is a perspective view of an article of apparel having at least a portion that includes awl features formed by the awl installed on the reciprocating machine of FIG. 1.

Once the awl features 13 are created, the sheet of material 14 can be used to form at least a portion of an article of apparel. For instance, as shown in FIG. 4, the sheet 14 can be used to form a portion of an article of footwear 46, having an upper 48, an outsole 50, and a midsole 52. The sheet 14 can be included as an individual panel of the upper 48 of the footwear 46, and can be attached to other portions of the footwear 46 via stitching, adhesives, or any other suitable manner. It will be appreciated that the sheet 14 can be cut from the bulk amount 40 to the final size before the awl features 13 are added; alternatively, the sheet 14 can be cut from the bulk amount 40, the awl features 13 can be added, and then the sheet 14 can be additionally cut before being attached to other portions of the footwear 46.

As stated, the sheet of material 14 is preferably cut from the bulk amount of material 40 prior to formation of the awl features 13, and then the sheet 14 is used to form the footwear 46 or other type of apparel. Accordingly, the method described herein can be particularly useful for producing highly customized, and/or apparel in relative low volumes. More specifically, because the awl features 13 are created on a relatively small sheet 14 (and not on a large, bulk amount 40), the awl features 13 can be more easily centered on the footwear 46 or other article of apparel.

Figure 5:
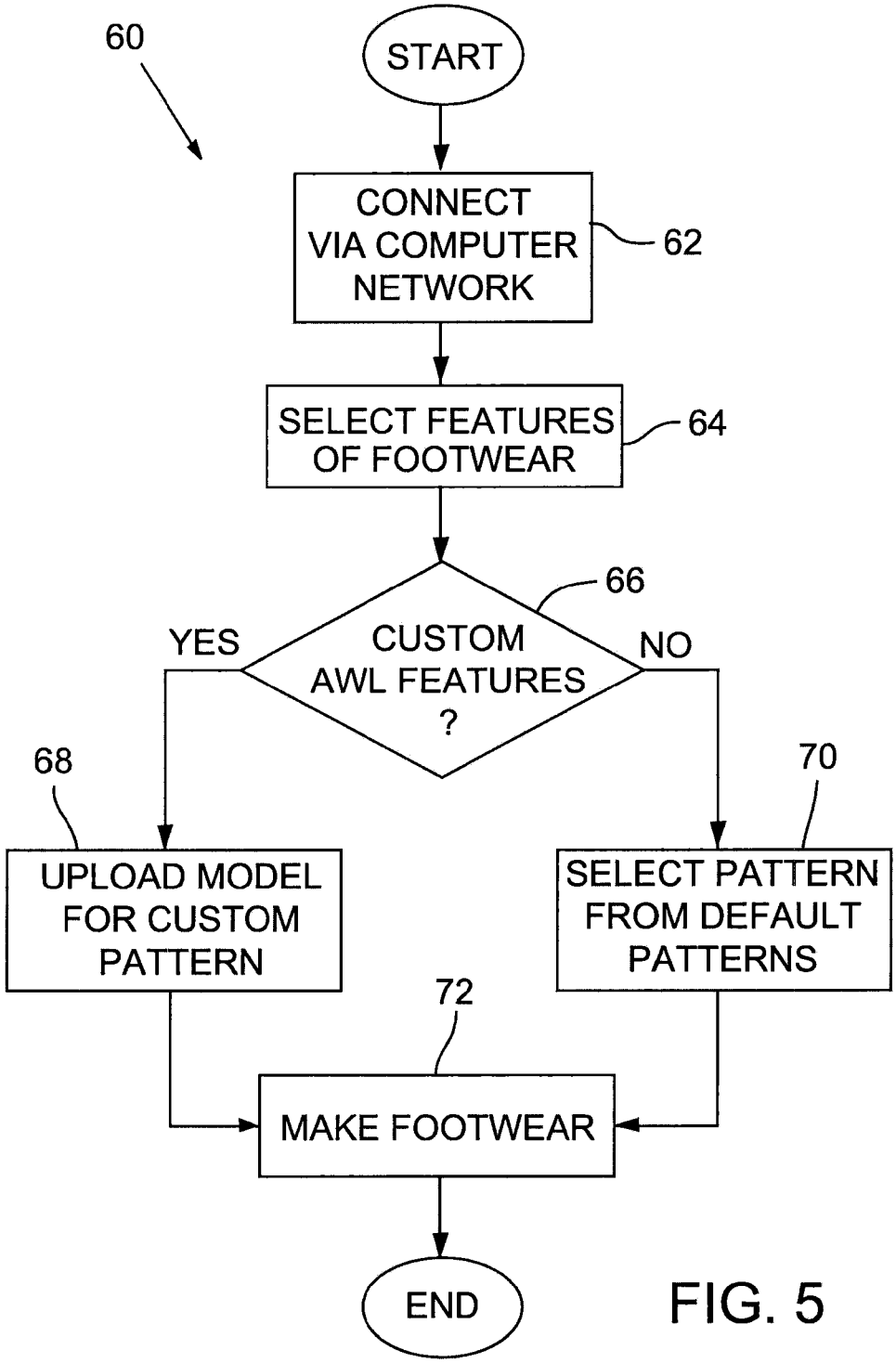
FIG. 5 is a flowchart illustrating a possible method of making awl features on a piece of material.

In some embodiments, the awl 10, 10' and the methods described above can be incorporated in a customized manufacturing process, which allows a user to select a pattern of awl features 13 to be included on a piece of apparel. For instance, these methods can be incorporated into an automated online user input system 100 (FIG. 1), which allows a user to customize and select various features of an article of footwear 46 or other apparel. One such system that is currently available is offered by Nike, Inc. of Beaverton, Oreg. and operates under the trademark NIKEID. FIG. 5 illustrates such a method 60.

As shown in FIG. 5, the method 60 begins in block 62, in which a user connects to a server 62 via a computerized network 102. Then, in block 64, the user selects various features of the footwear 46. More specifically, the user can select the colors, materials, shapes, logos, and other features of the footwear 46. These choices can be presented sequentially to the user over the network.

The user can also choose awl features 13 in block 64. Then, in decision block 66, it is determined whether the user would like to customize the awl features 13. For instance, some users may want the awl features 13 to represent a unique logo, picture, or the like. Thus, decision block 66 would be answered in the affirmative, and in block 68, the user uploads a model of the custom awl feature 13. For instance, the user could type an alphanumeric logo, transmit the logo over the computerized network, and the system would translate the alphanumeric logo into a corresponding pattern of awl features. The system also allows the user to select from various default (i.e., predetermined) patterns. More specifically, if decision block 66 is answered in the negative, block 70 follows, and the user can select a pattern of awl features 13 from a plurality of default patterns. Then, in block 72, the footwear 46 is formed with the customized or default awl features 13 using the reciprocating machine 12, the awl 10, 10', and manufacturing methods described in detail hereinabove.

Accordingly, the awl 10, 10' and the manufacturing processes detailed above allow for the manufacture of apparel with highly detailed patterns of awl features 13. The awl 10, 10' is extremely robust, and the awl 10, 10' can create highly intricate and attractive awl features 13. Furthermore, the manufacturing processes described above allow for the cost efficient customization of apparel.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An awl for use with a reciprocating device having a reciprocating portion, the awl comprising:

a mounting portion for operably engaging the reciprocating portion;

a shaft portion with an end for forming an awl feature on a sheet of material; and a mass portion for increasing the inertia of the awl when the reciprocating portion is reciprocated toward the sheet of material, wherein the end defines a substantially circular edge that is disposed in a plane, the plane being substantially perpendicular to the longitudinal axis.

2. The awl of claim 1, wherein the reciprocating device is one of a commercially available embroidery machine and a commercially available stitching machine.

3. The awl of claim 1, wherein the sheet of material is substantially planar.

4. The awl of claim 3, wherein the sheet of material is used to form at least a portion of an upper of an article of footwear.

5. The awl of claim 1, wherein the awl feature is at least one of a perforation, a perforation pattern, and a depression.

6. The awl of claim 1, wherein the mass portion and the shaft portion are integrally attached so as to be monolithic.

7. The awl of claim 1, wherein a width of the mass portion is greater than a width of the end.

8. The awl of claim 1, wherein the mass portion is substantially cylindrical.

9. The awl of claim 1, wherein the shaft portion includes a tapered portion that tapers from the mass portion to the end.

10. The awl of claim 9, wherein the tapered portion includes a first tapered portion and a second tapered portion having a different taper than the first tapered portion.

11. An awl for use with a reciprocating device having a reciprocating portion, the awl comprising:

a mounting portion for operably engaging the reciprocating portion;

a shaft portion with an end for forming an awl feature on a sheet of material; and a mass portion for increasing the inertia of the awl when the reciprocating portion is reciprocated toward the sheet of material.

12. The awl of claim 1, wherein the shaft portion is formed from a commercially available embroidery needle with an eyelet portion removed.

13. The awl of claim 1, wherein the mounting portion is detachably engageable to the reciprocating portion.

14. A method of making an awl feature in a sheet of material using a reciprocating device, the method comprising:

cutting the sheet of material from a bulk amount of material;

mounting the sheet of material relative to the reciprocating device after the sheet of material has been cut from the bulk amount of material;

operably engaging a mounting portion of an awl to the reciprocating device such that a shaft portion with an end extends generally toward the sheet of material, the awl also including a mass portion for increasing the inertia of the awl when reciprocated by the reciprocating device;

reciprocating the awl toward the sheet of material using the reciprocating device to form the awl feature on the sheet of material; and at least one of selecting an awl with a mass portion that supplies an adequate amount of inertia for forming the awl feature and adjusting a reciprocation control parameter of the reciprocating device for forming the awl feature.

15. The method of claim 14, wherein the at least one of selecting an awl with a mass portion that supplies an adequate amount of inertia for forming the awl feature and adjusting a reciprocation control parameter of the reciprocating device for forming the awl feature includes adjusting the reciprocation control parameter of the reciprocating device for forming the awl feature.

16. The method of claim 15, wherein adjusting the reciprocation control parameter includes at least one of adjusting a stroke velocity of the awl and adjusting a stroke force of the awl.

17. The method of claim 14, further comprising forming an upper of an article of footwear from at least a portion of the sheet of material.

18. The method of claim 14, further comprising providing a commercially available embroidery needle, and removing the eyelet portion from the embroidery needle to define the shaft portion of the awl.

19. The method of claim 14, further comprising pre-selecting the awl feature from a plurality of predetermined awl features.

20. The method of claim 14, further comprising uploading a model representing a customized awl feature that is different from a plurality of predetermined awl features.

21. The method of claim 14, further comprising transmitting a model representing the awl feature over a computerized network.

22. The method of claim 14, wherein operably engaging a mounting portion of an awl to the reciprocating device comprises operably engaging the mounting portion of the awl to one of a commercially available embroidery machine and a commercially available stitching machine.

23. The method of claim 14, wherein the at least one of selecting an awl with a mass portion that supplies an adequate amount of inertia for forming the awl feature and adjusting a reciprocation control parameter of the reciprocating device for forming the awl feature includes selecting the awl with the mass portion that supplies the adequate amount of inertia for forming the awl feature.

* * * * *